United States Patent [19]

Cullen, Jr.

[11] 4,247,994

[45] Feb. 3, 1981

[54] TEE LOCATED DEVICE FOR INDICATING THE POSITION OF A CUP IN A GOLF COURSE GREEN

[76] Inventor: Brown Cullen, Jr., 3611 Holston Rd., Louisville, Ky. 40222

[21] Appl. No.: 966,734

[22] Filed: Dec. 5, 1978

[51] Int. Cl.[3] ..... G09B 29/10

[52] U.S. Cl. ..... 434/153; 273/32 R

[58] Field of Search ..... 35/7 R, 7 A, 29 A, 40; 40/10 C; 116/272, 325, 326; 273/35 R, 35 A, 176 L

[56] References Cited

U.S. PATENT DOCUMENTS

| | | | |
|---|---|---|---|
| 1,150,668 | 8/1915 | Fusch | 35/40 |
| 1,410,811 | 3/1922 | Lewis | 35/29 A UX |
| 1,973,900 | 9/1934 | Hylander | 35/7 R |
| 2,048,906 | 7/1936 | Webster | 40/10 C |
| 3,685,168 | 8/1972 | Reitz | 35/7 A |

FOREIGN PATENT DOCUMENTS

| | | | |
|---|---|---|---|
| 773353 | 4/1957 | United Kingdom | 35/7 R |

*Primary Examiner*—Harland S. Skogquist
*Attorney, Agent, or Firm*—Mawhinney & Mawhinney & Connors

[57] ABSTRACT

A device for indicating to a golfer the location of the cup in the green of a hole on a golf course is composed of a plate that is either itself bodily shaped and formed to correspond on a relative basis to the shape and size of the green or is of a substantially rectangular shape and has pictorially depicted or otherwise formed on a viewable surface a visual representation on a relative basis of the shape and size of the green. Either plate is provided with a device for mounting it vertically on the tee at ground level and at an inclined angle to the perpendicular so that a golfer can easily glance at it while he is in the teeing area. The plate is provided with a plurality of apertures that represent various potential placements of the cup in the green and an indicating member is disposed on the viewable surface of the plate and removably fastened in one of the apertures to indicate where the cup is on the green.

5 Claims, 7 Drawing Figures

TEE LOCATED DEVICE FOR INDICATING THE POSITION OF A CUP IN A GOLF COURSE GREEN

BACKGROUND OF THE INVENTION (1) Field of the Invention

The present invention generally appertains to improvements in golf courses and, more particularly, relates to a new and novel device for imparting to the golfer, while he is in the teeing area, information regarding the placement of the cup in the green.

(2) Description of the Prior Art

It is recognized that in order to maintain the green of each hole on a golf course in good playing condition, the cup in the green of each hole must be periodically, most often on a daily basis, relocated on the green so as to prevent the green grass from becoming worn in spots. Further, it is the usual practice in tournament play for the cup in the green of each hole to be changed on a daily basis because if the cup were maintained in the same position in the green of each hole day after day, during tournament play, it can be appreciated that players would become accustomed to the set location and this would not offer the necessary challenge for playing each hole.

While it is usual in the maintenance of golf courses and customary during playing of tournaments for the cup in the green of each hole to be changed, nonetheless, it is difficult for golfers to approach a green from the tee if they have no information as to where the cup is located. Though the location of a cup is meant to be indicated to the golfer by a pin which is placed in the cup and has a flag at its upper end, there are many holes where only the top of the flag is visible and then at a substantial distance, and there are some holes, such as dog legs, where the flag is not visible at all from the tee.

It can be appreciated that greens are differently shaped, contoured and sized and given the varying placements of the cup in a green, it is difficult for a golfer as he tees off at the tee to know exactly how to play his tee shot. This is true even if a golfer is familiar with the size and shape of the green that he is approaching. Of course, given unfamiliarity with the course, it can be appreciated that a golfer would not know at all how to approach the green with his tee shot.

In U.S. Pat. No. 3,685,168, a display device for depicting a particular hole of a golf course is disclosed in an effort to overcome this problem. In such patent, a device is provided which is located in a position adjacent to the tee of each hole. Such device comprises a stand which supports at its upper end a horizontal housing within which an encased model of the green of a particular hole of a golf course is disposed under a locked sealing means. A marker in the form of a pin having a flag has a magnetic base so that it is positionable by magnetic means on the surface of the model simulating the actual green.

While such device offers advantages, it can be appreciated that a golfer must leave his teed up ball and go to the horizontally disposed relief model of the green and then come back to the teeing area. Apart from this disadvantage of use of the device in actual play, it can be appreciated that the device is of a complicated structural assembly and replacement of the magnetic marker requires unlocking of the casing so that the same can not be achieved in a quick and facile manner.

A simple solution to the problem has been to use a piece of paper or cardboard which is cut and shaped to simulate the green of a hole and which is tacked or otherwise affixed to the stand of a ball washer located in advance of the tee of each hole. The location of the pin is designated by a thumb tack pressed onto the surface of the cardboard. This arrangement is a temporary one and is not one that is reliable because it can be appreciated that the thumbtack can be easily changed in its position by one who is not authorized to do so. Also, the cutting of the paper or cardboard is on a haphazard basis since there is no deliberate attempt to simulate on a reduced scale the actual size and shape of the green. And the initial approved placement of the thumbtack is carried out on a rough or guesstimate basis, at best. For these reasons, the use of such guide has been limited to only one course in the southeastern part of the United States and, even at such course, the use is only on a spasmodic basis.

SUMMARY OF THE INVENTION

The foregoing brief review of the prior art, as it relates specifically to the playing of golf courses, indicates that there is a need for a device which can be utilized by a golfer, while he is in the teeing area, and which is of a such a simple structural nature that is can be positioned at each tee in a facile fashion, and yet which has a pin indicating device that cannot be accidentally dislodged or removed and which cannot be easily repositioned by an unauthorized person.

The present invention provides a solution to the problem of imparting knowledge to a golfer as to the placement of a pin on the green as he stands on the tee by providing a plate, which may be formed of any inexpensive but durable and hard material and which is shaped and sized so as to simulate the shape and size of the green associated with the tee of the particular hole. The plate can be substantially rectangular and has a viewable surface on which the size and shape of the green is pictorially depicted or otherwise formed. The plate is provided with means for mounting it at ground level and at an angle so that a golfer can easily view the upwardly facing surface of the plate at the tee area. The plate is disposed by the mounting means, which is embedded into the ground, at an obtuse angle to the ground and in such angular placement so that a golfer can easily glance at the viewable upper surface thereof. The plate is formed with a plurality of apertures which pass through the upper surface and the lower or under surface of the plate and which are arranged in a pattern of inch apart spacement relative to so many yards on the actual green.

A pin marking device, which is in the form of a bolt, is adapted to be placed in one of the apertures depending upon the particular placement of the cup on the green and has its head secured on the upper viewed surface of the plate by virtue of a nut threadingly secured on the threaded shank of the bolt at the lower or under surface of the plate. By this means, the bolt cannot be accidentally dislodged, nor can it easily mischievously replaced on the plate. The head of the bolt which simulates the pin can be colored or otherwise surface modified in contrast fashion to the surface of the plate so that it stands out and is easily viewed in relation to the overall upper surface of the plate.

The device can be positioned at each end of the tee between the balls that mark off the tee area or the device can function for tee area marking purposes in place of the standard balls.

It can be appreciated that a primary object of the present invention is to provide a miniature display device for visually depicting the placement of a pin and cup on the green of a hole of a golf course with the device being disposed at ground level and at an angular placement to the ground so that it can be easily viewed by a golfer while he is in the teeing area.

Another important object of the present invention is to provide a simple, sturdy and inexpensive device for depicting placements of a cup in a green with the device being unaffected by weather elements and being of such a sturdy endurable nature as to remain in use for considerable periods of time.

A further important object of the present invention is to provide a simple flat plate which is sized and shaped to represent on a relative basis the size and shape of a green and which is provided with mounting means adapted to be easily embedded into the ground so as to securely position the plate on the tee at ground level and at an angle so that it can be easily viewed by a golfer while on the tee with the plate being multiapertured and with a simple bolt being provided for selective placement in one of the apertures to indicate the exact position of the cup in the green of the golf course hole.

DESCRIPTION OF THE PREFERRED EMBODIMENT

Figure 1:
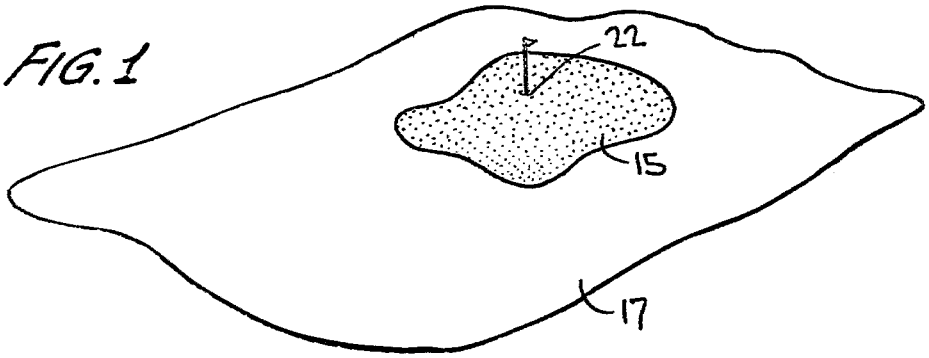
FIG. 1 is a perspective view of a hole of a golf course showing a green with the flag pin positioned in the cup.

With more specific reference to the accompanying drawings, the cup indicating device 10, as shown in structural detail in FIGS. 2–4 and 6, includes a flat plate 12, which can be formed from any suitable sturdy structural material of a rigid nature, such as plastic, metal, wood, fiber board, or the like. The plate is peripherally shaped and its edges 14 outlined so the plate represents on a relative basis the shape of the green 15 of the hole 17, as diagrammatically depicted in FIG. 1. The outline or peripheral contour of the plate 10 will vary depending upon the given shape of the green 15. But the peripheral outline of the plate will correspond to and be simulative of the green with which it is associated. Thus, the plate will be a miniature replica of the green, as can be appreciated when considering the green 17 of FIG. 1 and the plate 12 of FIG. 2.

The plate 12 is formed with a plurality of apertures 16 that extend completely therethrough and through the upper or outer surface 18 and the lower or under surface 20. The apertures 16 are formed through the plate on a geometrical pattern to correspond to and represent any given positioning of the cup 22 in the green 15. The apertures are arranged through the surfaces or faces of the plate and are patterned in an arrangement on the plate wherein the spacing between the apertures is on an inch-by-inch basis which relates to a yard-by-yard spacement on the green 15 of actual placements of the cup 22 therein. For example, the apertures 16 are spaced apart a distance of one inch which equals a spacement of five yards of the potential placement of the cup 22 in the green 15. Such correlation of the positioning of the apertures in relation to the overall size of the plate is visually depicted to the golfer, as will be described.

Figure 5:
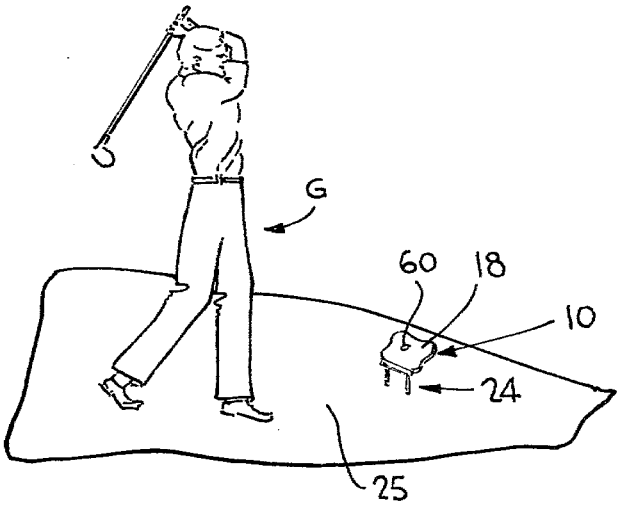
FIG. 5 is a perspective view showing the use of the indicating device in actual play and depicting the ground level placement thereof at an angle with respect to the golfer.
Figure 6:
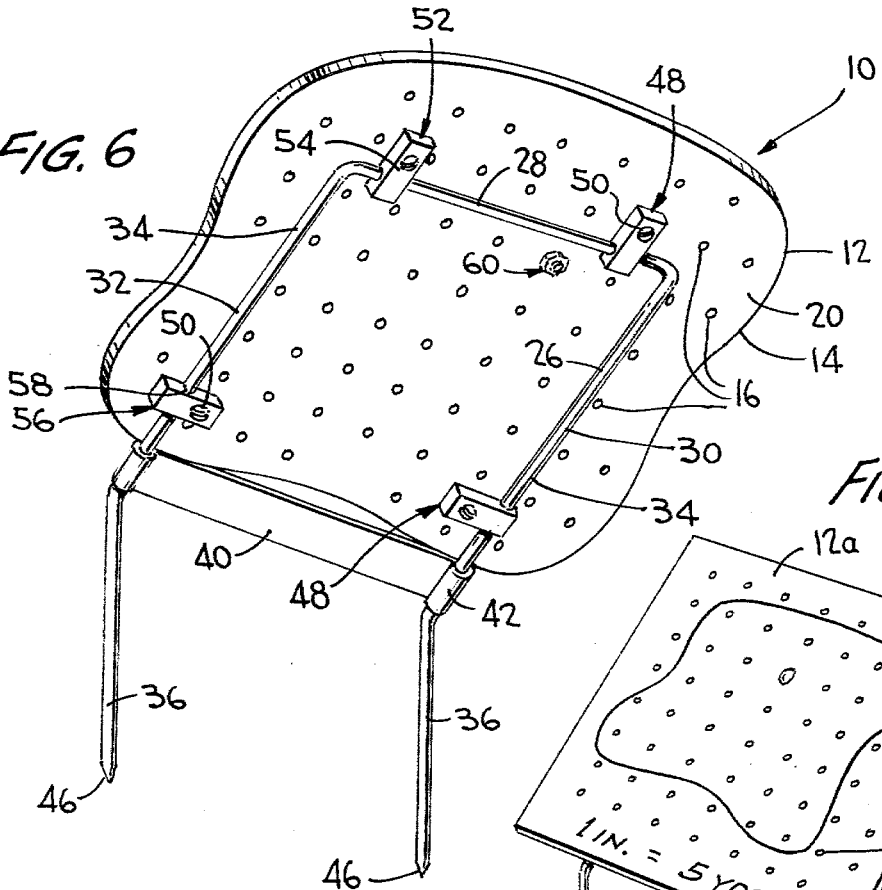
FIG. 6 is a rear perspective view of the device, showing in detail the mounting or supporting means.

Mounting or supporting means 24 is provided for anchoring the plate at ground level on the tee 25, as shown in FIG. 5. The mounting means 24 includes a one-piece generally U-shaped support 26 which can be formed from any suitable wire-like material of a sturdy nature, such as steel, or the like. The mounting or supporting means 26 has a bight portion 28 from which legs 30 and 32 extend in parallel fashion, with the legs having inner portions 34 and outer free portions 36. The inner portions 34 of the legs are coplanar with the bight portion 28 and are adapted to be placed substantially flat therewith against the lower or under surface 20 of the plate 12, as can be appreciated from FIG. 6.

Figure 2:
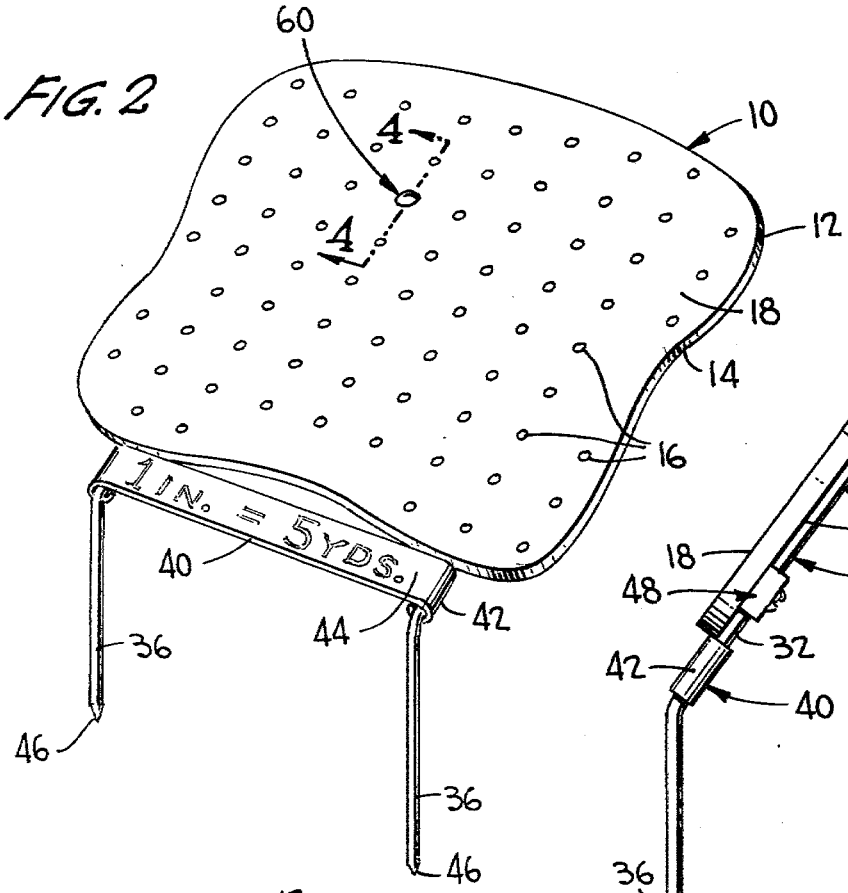
FIG. 2 is a perspective view of the device of the present invention showing the location of the cup in the green of the hole in FIG. 1 with the plate of the invention being contoured similar to the contour of the green of the hole of FIG. 1.
Figure 3:
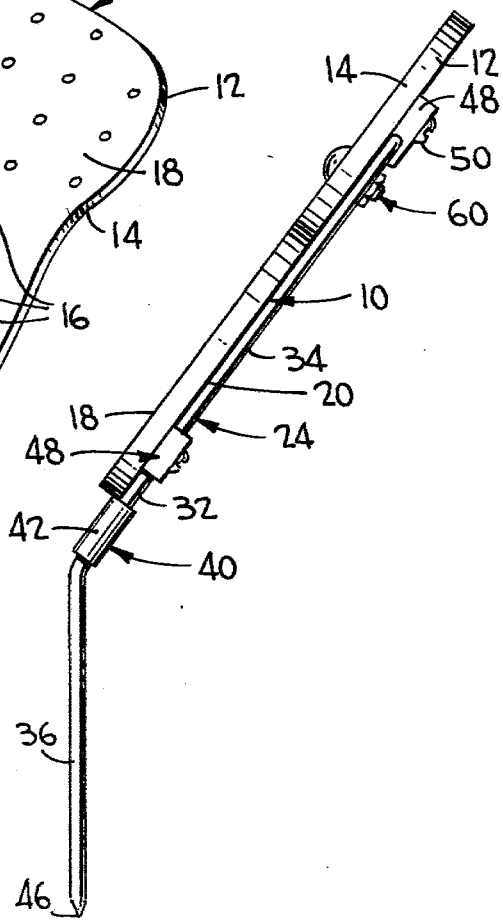
FIG. 3 is a side elevational view of the cup indicating device of FIG. 2.
Figure 4:
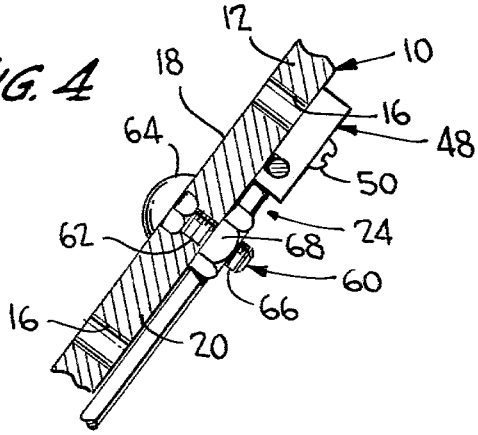
FIG. 4 is a fragmentary vertical sectional view taken substantially on line 4–4 of FIG. 2.

The legs 30 and 32 project slightly at their outer ends beyond the lower peripheral portion 38 of the plate so as to support an elongated strip 40, which can be formed from hard plastic or metal and which has end portion 42 that are fixedly looped around the extending outer ends of the legs 30 and 32 so as to mount the strip 40 at the lower portion of the plate 12. The strip 40 has an outer surface 44 which is on the same viewing plane as the outer surface 18 of the plate 12 and which bears information relative to the arrangement of the apertures 16 in the plate in relation to the placement of the cup 22 in the green 15 of the hole. For example, as shown in FIG. 2, the outer face of the strip is formed with indicia "1 in. = 5 yds." This imparts the knowledge to the golfer G while he is in the teeing area that the apertures are arranged in the plate 12 on a basis of one inch relative spacement for five yards placement of the cup 22 in its various positions in the green 15. This also imparts to the golfer knowledge as to the placement of the cup in relation to the center and the edges of the actual green 15.

The outer end portions 36 of the legs are bent downwardly at an obtuse angle relative to the plate and the inner end portions 34 and terminate in pointed free ends 46, which enable the end portions 36 of the legs to be easily embedded in the ground.

The inner end portions 34 of the legs 30 and 32 lie substantially flat with the bight portion 28 against the lower or under surface 20 of the plate 12. And the legs and bight portion are arranged on such surface so as not to block off any of the apertures 16, as can be appreciated from a consideration of FIG. 6. The lower or under surface 20 of the plate 12 is provided with anchoring blocks 48 that are fixedly superimposed thereon by means of anchoring screws 50 which are of such a nature that they do not structurally protrude through or show through the upper or outer surface 18 of the plate 12. The blocks 48 are arranged in vertical and horizontal pairs with one pair 52 being vertically arranged on the plate so as to receive by means of bores 54 formed transversely through the blocks the bight portion 28 while the other pair 56 of blocks is horizontally arranged so that the blocks receive in their transverse bores 58 the leg portions 30 and 32. The bores are formed transversely through the blocks and are of a cross-sectional size to snugly receive the round bight portion and round legs of the anchoring member and the screws 50 hold the blocks tightly against the under or lower surface 20 of the plate 12 so as to securely anchor the bight portion and leg portions to the under surface 20 of the plate with the outer leg portions 36 depending angularly therefrom, as can be well appreciated from FIG. 3.

Pin indicating means 60 is provided and is of such a nature to cooperate with the apertures 16 in a facile placement manner, but in such a way that the pin indicating means 60 cannot be accidentally dislodged nor can it be mischievously easily removed and replaced. The pin indicating means 60 is in the form of a bolt 62 which has a head 64 and a threaded shank 66. The shank is passed through a selected one of the apertures with the head 64 being positioned firmly on the upper or outer surface 18 of the plate and held thereon by means of a nut 68, which is fastened on the protruding threaded end of the shank portion 66 at the under surface 20 of the plate. The head 64 can be colored or otherwise surface conditioned or shaped so as to contrast with the upper surface 18 of the plate and stand out in contrast thereto whereby it will be clearly visible in relation to the overall contour, shape and size of the plate 12 to a golfer while viewing the same from a position on the tee.

Thus, it can be understood from a consideration of FIG. 5 that the display device 10 is mounted in a suitable ground level placement on the tee 25 so that the upper or outer viewed surface 18 of the plate 12 is easily viewed by a golfer G as he stands on the tee 25 before hitting his tee shot. At the same time as the golfer readies his tee shot he can mentally picture the entire green to be approached and can know the positioning of the cup in relation to the green with which he has become familiar by virtue of the plate 12 being a miniature replica of the green 15.

Figure 7:
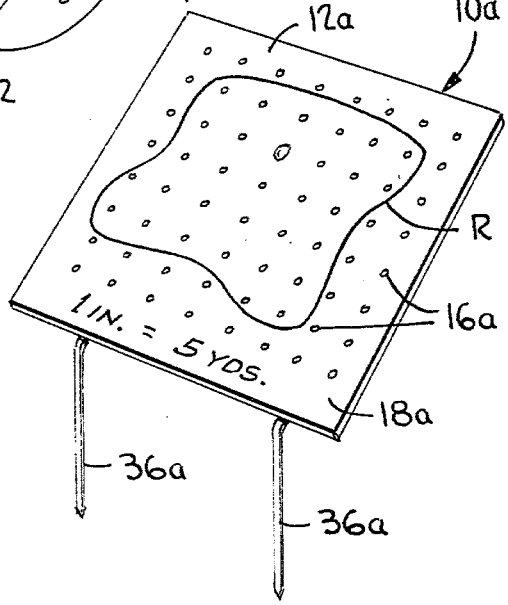
FIG. 7 is a perspective view of a modified form of the device.

As shown in FIG. 7, the device 10*a* can be composed of a substantially rectangular plate 12*a* which is formed with a plurality of apertures 16*a* in the same manner as the plate 12. The plate is supported at its lower end by ground engaging legs 36*a* is disposed at substantially the same angle thereto as the leg portions 36 are to the plate 12 in FIG. 3. The legs 36*a* are attached to and carried by the plate 12*a* in the same manner and way as the legs are attached to and carried by the plate 12 of FIGS. 1–6. On the viewable upper or outer surface 18*a* of the plate 12*a* a representation R of the green 17 is pictorially depicted, as by being painted thereon or structurally fashioned thereon by a piece of plastic or the like being fixedly superimposed thereon. Below the green simulating representation R the plate 12*a* is provided with indicia such as carried by the strip 40 and for the same purpose. Also, it can contain indicia designating the number of the hole and the yardage thereof, as can the strip 40.

While the best known forms of the present invention has been described herein and shown in the accompanying drawings, it is to be understood that such is merely exemplary and that the invention is only limited by the scope of the appended claims.

What is claimed is:

1. A golfing aid for visually imparting to a golfer, while he is situated at the tee area of a hole of a golf course and even while he is standing at his teed up ball at the tee area, conside information regarding the size and shape of the green for such hole and the particular placement in the green of the cup comprising:

(a) a member adapted to be fixedly mounted immediately at the tee area and disposed in vertical relation to the ground and having a face viewable by the golfer from a position at his teed up ball in the tee area;

(b) means carried by said member for securely attaching it to the ground in such vertical relation to the ground so that said face can be visually viewed by a golfer while at the tee area, and even while at his teed up ball;

(c) means on said member viewably located at said face and visually depicting on a reduced scale the exact size and shape of the green;

(d) said last means being formed over its entire physical extent with a patterned series of apertures that are viewable at said face and extend therethrough and which are arranged in an inch to inch spacement in relation to a yard to yard spacement on the green with an inch being representative of a yard of the green;

(e) a display element selectively inserted through the apertures and having an outer end bearing against the means visually depicting the green which end visually simulates the cup in the green;

(f) said display element having a shank selectively inserted in the apertures; and, (g) means carried by the shank for positively locking it in a selected aperture so that the display element is secured in position against unauthorized displacement.

2. The invention of claim 1 wherein said member is located at ground level in a position at an inclined angle to the ground so that said face constitutes an upper face.

3. The invention of claim 1 wherein said attaching means includes ground penetrating means depending from the member.

4. The invention of claim 1 and including means carried by said member and located in relation to the green size and shape viewable means so that it can be seen by the golfer as he views said face of the member with said means visually presenting to the golfer the inch patterned arrangement of the apertures in relation to a given yardage of the green.

5. The invention of claim 4 wherein said means is visually displayed on the member to be viewed simultaneously with said face and imparts information of an inch being equal to a given number of yards of the green.

* * * * *